US007152440B1

(12) United States Patent
Austin

(10) Patent No.: US 7,152,440 B1
(45) Date of Patent: Dec. 26, 2006

(54) APPARATUS TO SECURE AN ACCESS DOOR ON A HOUSING

(75) Inventor: Andrew G. Austin, Sherwood, OR (US)

(73) Assignee: InFocus Corporation, Wilsonville, OR (US)

( * ) Notice: Subject to any disclaimer, the term of this patent is extended or adjusted under 35 U.S.C. 154(b) by 0 days.

(21) Appl. No.: 09/974,556

(22) Filed: Oct. 9, 2001

(51) Int. Cl.
*E05B 73/00* (2006.01)

(52) U.S. Cl. ..... 70/58; 70/164; 70/169; 70/173; 353/119

(58) Field of Classification Search ..... 70/58, 70/162, 164, 169, 173; 353/119, 101, 85, 353/87

See application file for complete search history.

(56) References Cited

U.S. PATENT DOCUMENTS

| | | | | |
|---|---|---|---|---|
| 4,627,589 | A * | 12/1986 | Hotsumi | 70/58 X |
| 5,327,752 | A | 7/1994 | Myers et al. | 70/58 |
| 5,374,969 | A * | 12/1994 | Kyhl et al. | 353/119 |
| 5,381,685 | A | 1/1995 | Carl et al. | 70/78 |
| 5,502,989 | A | 4/1996 | Murray, Jr. et al. | 70/58 |
| 5,526,226 | A * | 6/1996 | Katoh et al. | 70/164 X |
| 5,526,227 | A * | 6/1996 | Satou et al. | 361/684 |
| 5,548,981 | A | 8/1996 | Kirk | 70/58 |
| 5,622,064 | A | 4/1997 | Gluskoter et al. | 70/14 |
| 5,687,592 | A * | 11/1997 | Penniman et al. | 70/14 |
| 5,787,737 | A | 8/1998 | Cho | 70/58 |
| 5,855,488 | A * | 1/1999 | Heintz et al. | 439/310 |
| 5,960,651 | A * | 10/1999 | Tanisawa | 70/14 |
| 5,987,937 | A * | 11/1999 | Lee | 70/14 |
| 6,088,229 | A * | 7/2000 | Seto et al. | 70/58 X |
| 6,095,574 | A * | 8/2000 | Dean | 292/164 |
| 6,144,360 | A * | 11/2000 | Evanicky et al. | 345/102 |
| 6,170,304 | B1 | 1/2001 | Ohta | 70/14 |
| 6,193,287 | B1 | 2/2001 | Li et al. | 292/37 |
| 6,275,378 | B1 * | 8/2001 | Lee et al. | 70/58 X |
| 6,345,896 | B1 * | 2/2002 | Kurosawa | 353/119 |

* cited by examiner

*Primary Examiner*—Lloyd A. Gall
(74) *Attorney, Agent, or Firm*—Alleman Hall McCoy Russell & Tuttle LLP

(57) ABSTRACT

A latch assembly to secure an access door on the housing of an electronic device. When a conventional locking device is coupled with the housing to deter theft of the electronic device as a whole, the latch assembly will maintain the access door in a closed position and deter theft of any component accessible via the access door.

24 Claims, 12 Drawing Sheets

APPARATUS TO SECURE AN ACCESS DOOR ON A HOUSING

FIELD OF THE INVENTION

The invention relates generally to theft prevention for portable devices, such as projectors, computers, and the like. Specifically, the invention relates to a latch assembly for securing an access door on the housing of such a portable device.

BACKGROUND OF THE INVENTION

To satisfy customer demand, electronics manufacturers must continuously strive to produce electronic devices—such as projectors, laptop computers, desktop computers, and computer peripherals (e.g., monitors, printers, keyboards, scanners)—that exhibit lighter weight and smaller size for ease of transportation. As these electronic devices become increasingly portable, there is a corresponding increase in their susceptibility to theft. Theft prevention is, therefore, a great concern for such portable electronic devices, and numerous security devices for deterring theft of electronic devices are now available, including locks, cables, mounting plates, docking stations, and secure enclosures.

One type of security device is a cable lock, as disclosed in U.S. Pat. No. 5,381,685, assigned to Kensington Microwave Limited, and U.S. Pat. No. 5,327,752, assigned to the same. This type of cable lock is often referred to as a "Kensington® style" lock. An exemplary embodiment of such a Kensington® style lock 10 is shown in FIG. 1. The cable lock 10 includes a lock body 12 having one end of a cable 14 attached thereto, an opposing end of the cable 14 being secured to an anchoring device or other structure (not shown in FIG. 1). Protruding from the lock body 12 is a locking assembly 16. The locking assembly 16 comprises a lock head 17, which rotates as denoted by arrow 19, and one or more anti-rotation elements 18. Typically, the lock assembly 16 is actuated by a key (not shown in FIG. 1), although the cable lock 10 may alternatively comprise a combination lock.

Operation of the Kensington® style lock is illustrated in FIGS. 3 and 4. The lock head 17 is inserted within a slot 35 extending through the housing wall 30 of an electronic device, the lock head 17 exhibiting a first orientation generally congruent with slot 35. Generally, the slot 35 is configured according to a standard slot size and orientation.

Referring now to FIG. 4, upon actuation of the locking assembly 16, the lock head 17 rotates through a predetermined angle (e.g., ninety degrees, as shown in FIG. 4) to a second orientation. In the second orientation, the lock head 17 is retained by the housing wall 30, as the width of slot 35 does not allow passage of the lock head 17. Counter rotation elements 18, which protrude into the slot 35, prevent rotation of the lock body 12 relative to the slot 35. Thus, when the lock head 17 exhibits the second orientation, as illustrated in FIG. 4, the housing wall 30 is securely coupled with the cable lock 10, and the cable lock 10 is, in turn, secured to an anchoring device or other structure to deter theft of the electronic device.

Another type of cable lock—sometimes referred to as a "scissors lock" or "scissors clip"—is shown in FIG. 2. The scissors lock 20 includes a lock body 22 having one end of a cable 24 attached thereto, an opposing end of the cable 24 secured to an anchoring device or other structure (not shown in FIG. 2). Extending from the lock body 22 is a locking assembly 26. The locking assembly 26 comprises a lock head 27 having three movable arms 27*a*, 27*b*, and 27*c*. The movable arms 27*a*, 27*b*, 27*c* are each movable along a transverse axis 29, the movable arms 27*a*, 27*b* moving in one direction along axis 29 during actuation of lock assembly 26 and the movable arm 27*c* moving in an opposing direction upon actuation, as will be explained in greater detail below. Each movable arm 27*a*, 27*b*, 27*c* has a prong 28*a*, 28*b*, 28*c* extending therefrom, respectively. The lock assembly 26 is typically actuated by a key (not shown in FIG. 2), although the scissors lock 20 may alternatively comprise a combination lock.

Operation of the scissors lock 20 is illustrated in FIGS. 5 and 6. Referring to FIG. 5, the lock head 27 may exhibit a first orientation wherein the movable arms 27*a*, 27*b*, 27*c* are each retracted and the lock head 27 can slidably mate with the slot 35. The lock head 27, while exhibiting the first orientation, is inserted within the slot 35 on housing wall 30.

Upon actuation of the locking assembly 26, as shown in FIG. 6, the lock head 27 will exhibit a second orientation. In the second orientation of lock head 27, the movable arms 27*a*, 27*b* are extended transversely in one direction while the movable arm 27*c* is extended transversely in an opposing direction, such that the arms 27*a*, 27*b*, 27*c* are fully outwardly extended and engage the perimeter of the slot 35 (or are substantially near the perimeter of slot 35). Accordingly, each of the prongs 28*a*, 28*b*, 28*c* on movable arms 27*a*, 27*b*, 27*c* extends over the surface of housing wall 30, and the lock head 27 is retained by the housing wall 30, as the width of slot 35 does not allow passage of the fully extended movable arms 27*a*, 27*b*, 27*c*. The movable arms 27*a* –*c*, when fully extended outward, substantially prevent rotation of the lock body 22 relative to the slot 35. Therefore, when the lock head 27 exhibits the second orientation, as illustrated in FIG. 6, the housing wall 30 is securely coupled with the scissors lock 20, which may be secured to an anchoring device or other structure to deter theft of the electronic device.

It is common for the housing of an electronic device to include one or more movable doors or panels permitting access to an interior of the housing. Often times, a movable door is sized and located on the housing to permit access to a specific part, and this part may comprise a critical component of the electronic device and, further, may be easily removable. For example, the housing of a projector may include an access door that, upon opening, permits a user to gain access to a lamp or other light source, the lamp being critical to functioning of the projector, easily removable, and, in many instances, comprising a significant portion of the overall system cost. Although each of the above-described locking devices may provide a secure coupling between an electronic device and an anchor or other structure, neither of these devices will deter theft of such a critical and/or removable part on the electronic device.

To secure an access door on the housing of an electronic device and provide theft prevention for any part accessible through that access door, a separate lock apparatus may be coupled with the access door to secure the access door in a closed position. However, such an approach requires a separate lock apparatus for the access door (or for each access door, if more than one). A user must perform separate locking operations to both secure an access door on the housing and secure the housing to some other structure. Further, the user will likely need to maintain separate keys or access codes for each of the access door and any locking device used to deter theft of the electronic device as a whole.

Alternatively, theft prevention for individual parts or components may be achieved by simply omitting access doors from the housing of an electronic device. However, such an approach may prove cumbersome, as the entire housing of the electronic device must then be removed to gain access to any parts within the housing.

SUMMARY OF THE INVENTION

An electronic device includes a housing having an access door permitting access to an interior of the housing. The housing also has a slot extending therethrough that is sized and located to receive the lock head of a locking device when the lock head exhibits a first orientation. The lock head of the locking device will be retained in the slot when the lock head exhibits a second orientation. A latch assembly disposed in the housing maintains the access door in a closed position in response to the lock head exhibiting the second orientation.

DETAILED DESCRIPTION OF THE INVENTION

Figure 1:
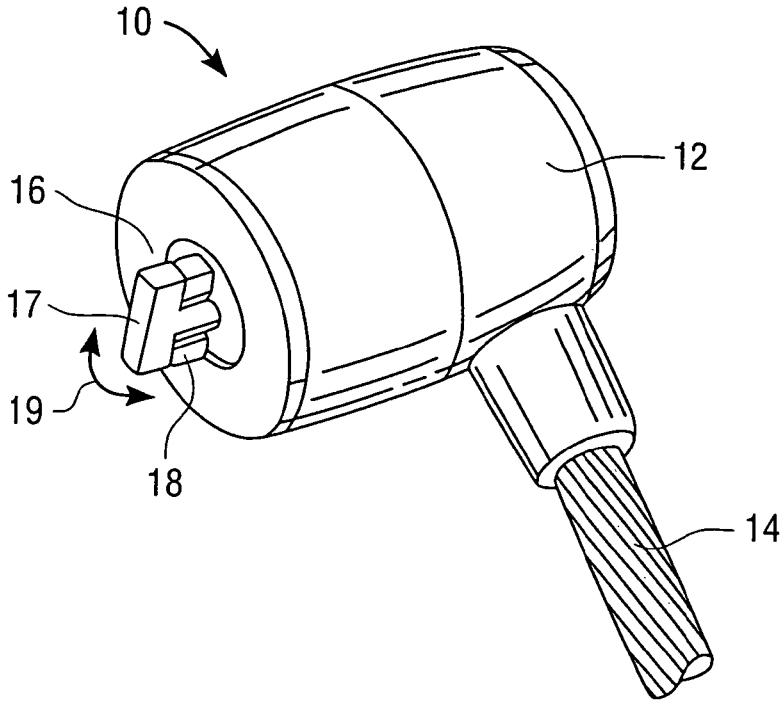
FIG. 1 (PRIOR ART)
FIG. 1 shows an exemplary embodiment of a conventional Kensington® style cable lock.
Figure 2:
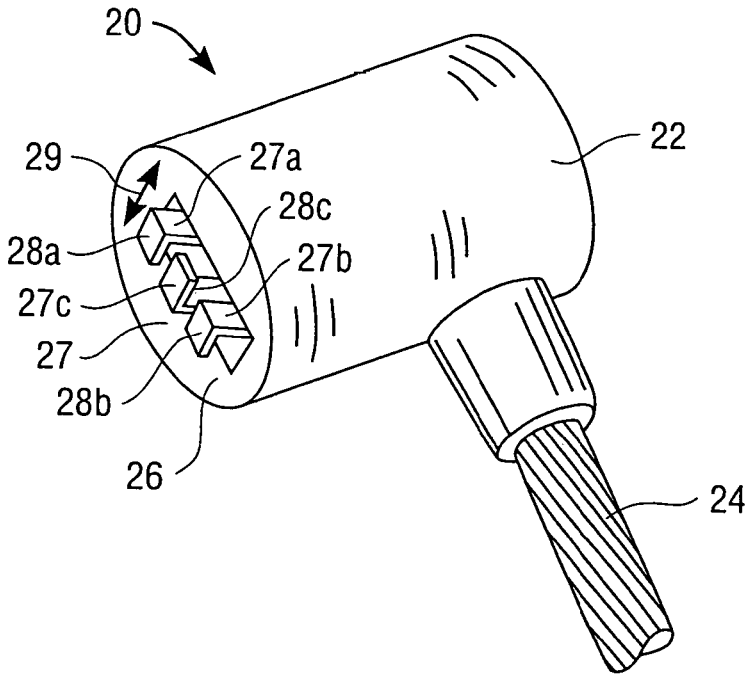
FIG. 2 (PRIOR ART)
FIG. 2 shows an exemplary embodiment of a conventional scissors lock.
Figure 3:
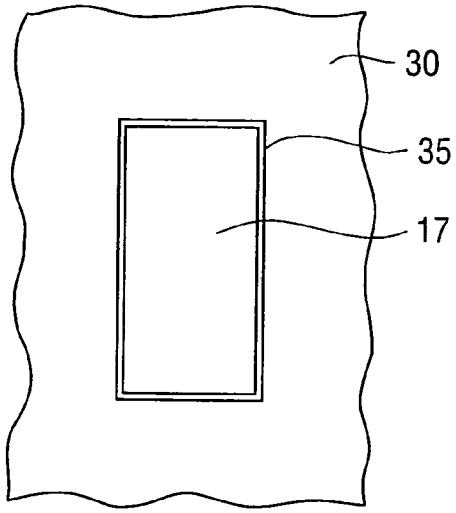
FIG. 3 (PRIOR ART)
FIG. 3 shows the cable lock of FIG. 1 in a first orientation, as engaged with the housing wall of an electronic device.
Figure 5:
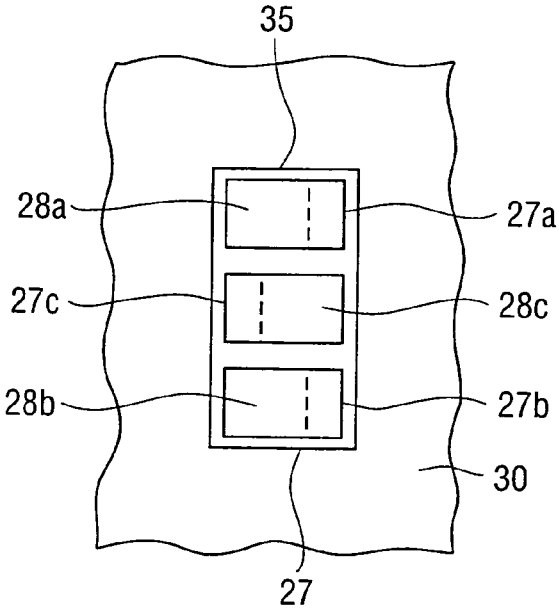
FIG. 5 (PRIOR ART)
FIG. 5 shows the scissors lock of FIG. 2 in a first orientation, as engaged with the housing wall of the electronic device.
Figure 6:
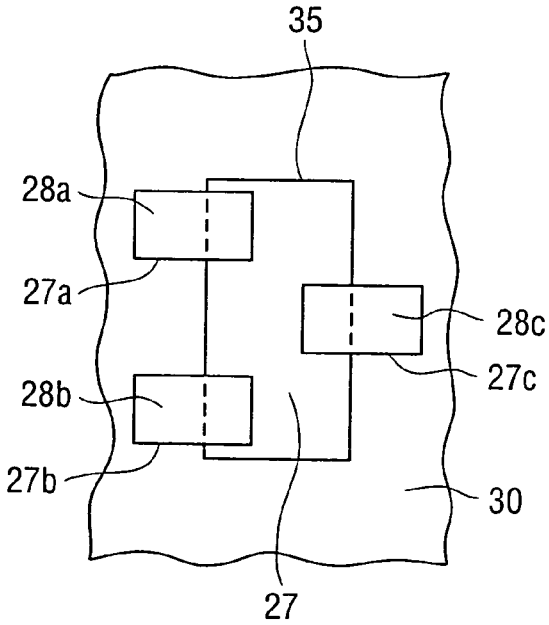
FIG. 6 (PRIOR ART)
FIG. 6 shows the scissors lock of FIG. 2 in a second orientation, as engaged with the housing wall of the electronic device.
Figure 7:
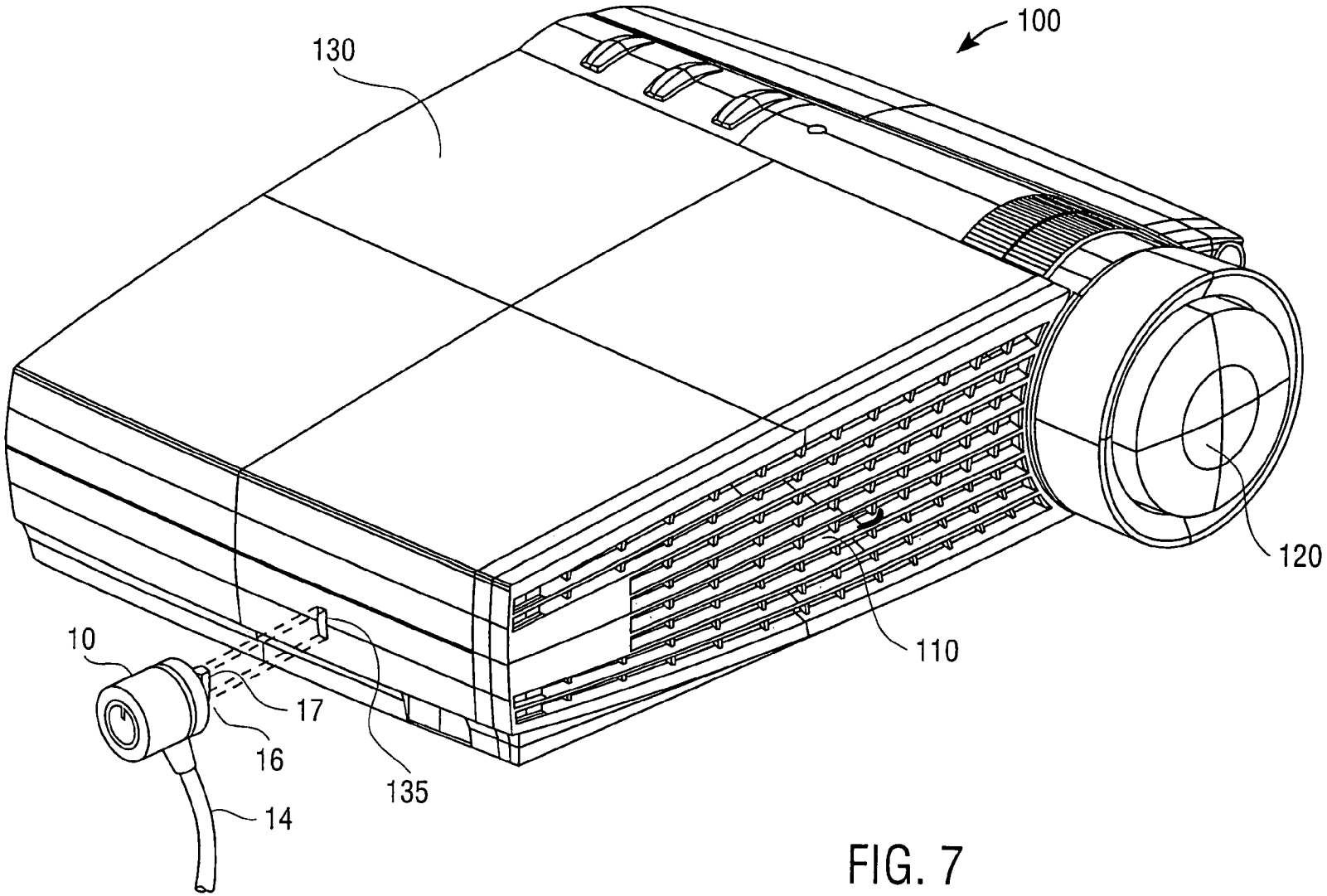
FIG. 7 is a perspective view of an electronic device having an access door and a slot for receiving the cable lock of FIG. 1 or the scissors lock of FIG. 2.

Referring to FIG. 7, an electronic device 100 has a housing 130 including an access door 110 and further including a slot 135 extending through a wall thereof. The access door 110 comprises any movable door or panel, whether slidable, rotatable about a hinge, or removable. As illustrated in FIG. 7, the access door 110 is in a closed position. Generally, the slot 135 is of a standard size and orientation adapted to receive, for example, the Kensington® style cable lock 10 shown and described with respect to FIGS. 1, 3, and 4. The slot 135 may also receive the scissors lock 20 shown and described with respect to FIGS. 2, 5, and 6, as well as any other suitable locking device known in the art that is configured for use with slot 135.

Figure 8:
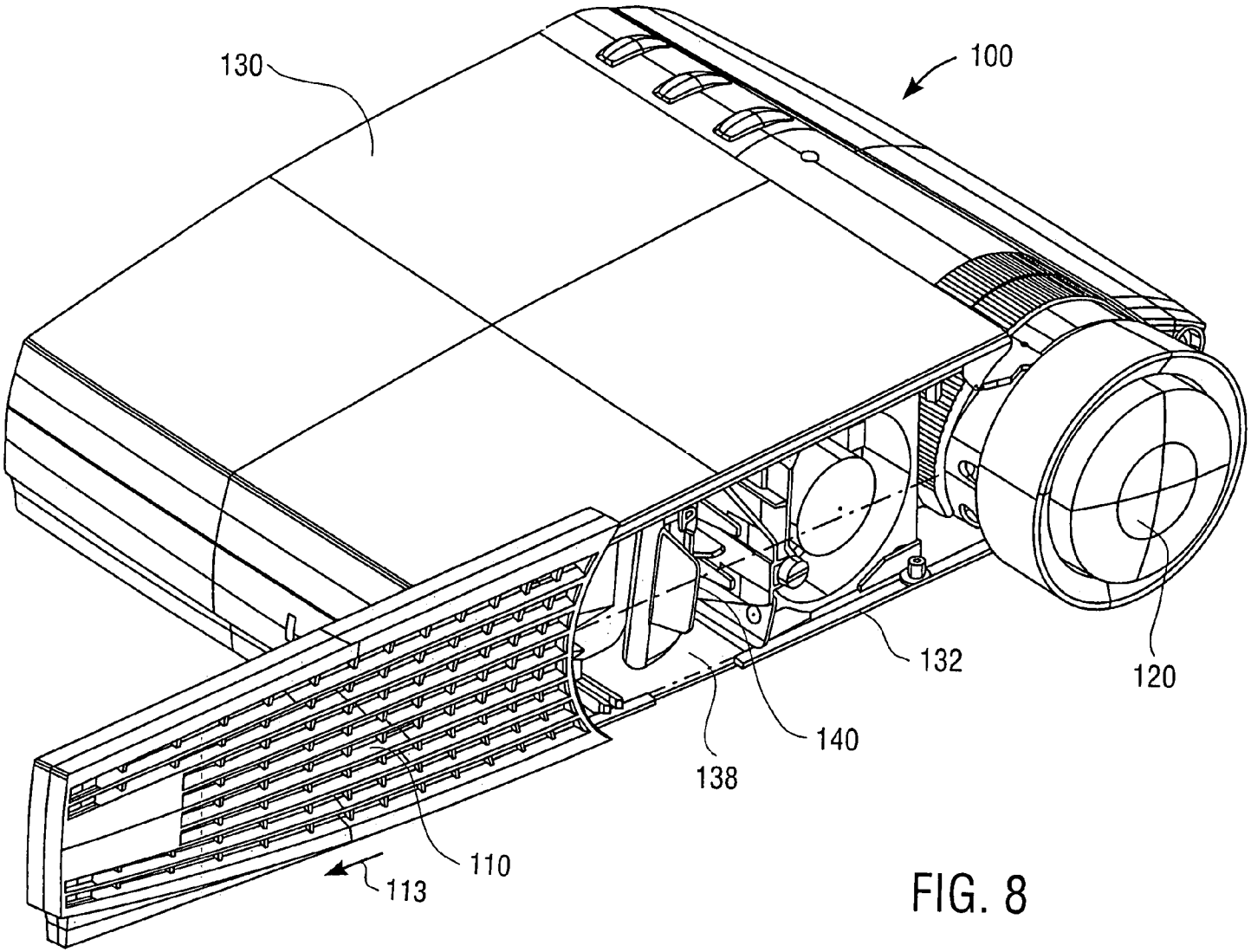
FIG. 8 is a perspective view of the electronic device of FIG. 8, wherein the access door has been moved toward an open position.

The electronic device 100 comprises, in this exemplary embodiment, a projector, which includes a lens assembly 120. Referring now to FIG. 8, the electronic device 100 is shown with the access door 110 at an open position, thereby exposing an interior cavity 138 of housing 130. The access door 110 is moved toward the open position by sliding the access door 110 in a direction denoted by arrow 113. Disposed within the interior cavity 138—the interior cavity 138 being defined by a wall 132 of housing 130—is a part or component, which, in the illustrated embodiment, is a removable lamp assembly 140.

It should be understood that, although the detailed description is presented in the context of a projector, the present invention is not so limited. As those of ordinary skill in the art will appreciate, the present invention is applicable to any type of electronic device—such as, for example, desktop computers, laptop computers, and computer peripherals—as well as non-electronic devices.

As noted above, conventional security devices—such as the Kensington® style lock 10 and the scissors lock 20—provide theft prevention for an electronic device as a whole, but these conventional security measures do not provide theft deterrence for any particular part or component on the electronic device. However, according to the present invention, theft prevention for the removable lamp assembly 140 (or, generally, for any critical and/or removable part) on electronic device 100 is provided by a latch assembly coupled with the access door 110, as set forth below in greater detail. The latch assembly secures the access door 110 on housing 130 in conjunction with any conventional locking device, such as the Kensington® style lock 10 or the scissors lock 20, wherein the locking device may simultaneously provide theft deterrence for electronic device 100 as a whole.

Figure 9:
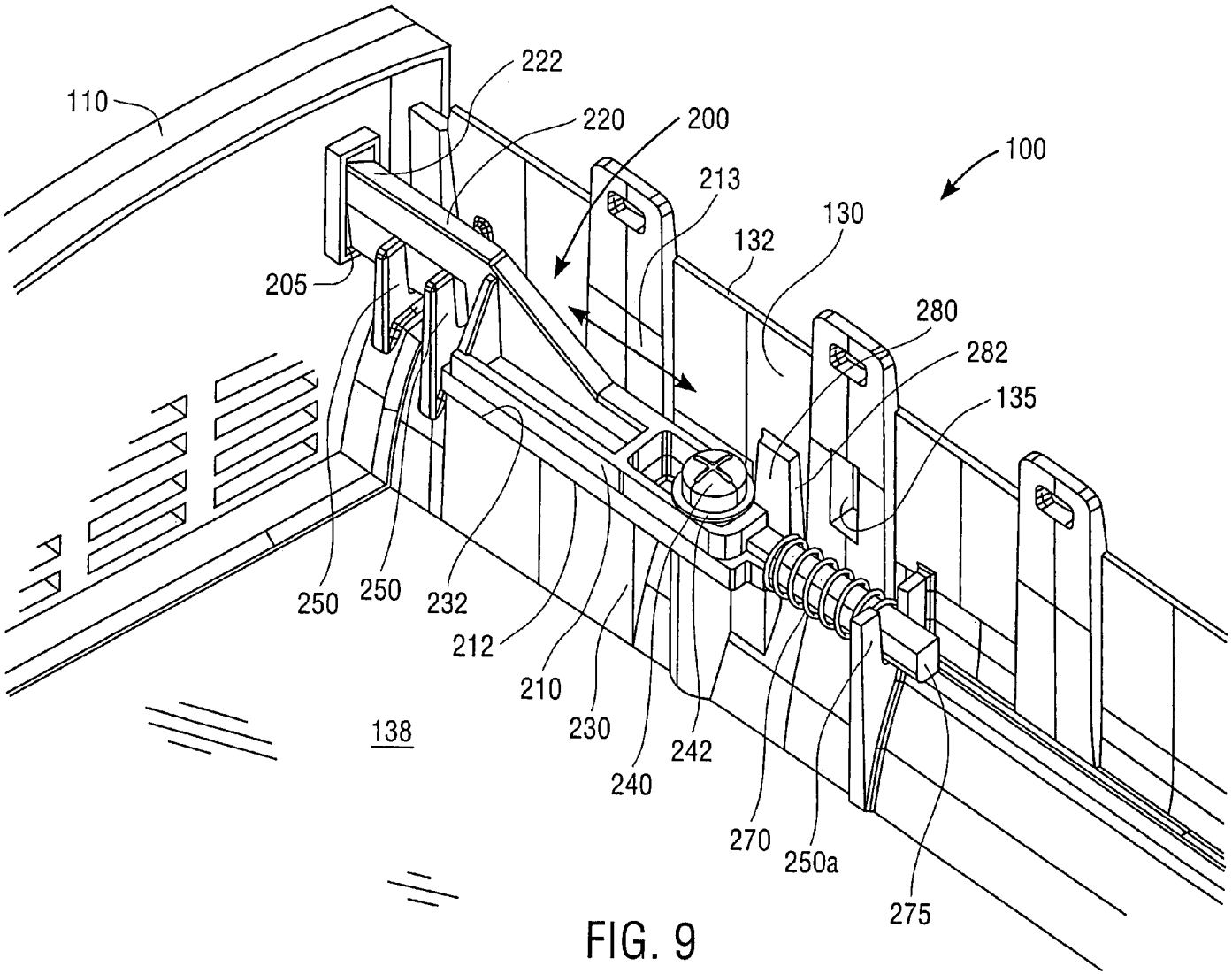
FIG. 9 is a perspective view of an interior cavity of the electronic device of FIG. 8 and further showing an embodiment of a latch assembly.

One embodiment of a latch assembly 200 is illustrated in FIG. 9, the latch assembly 200 being disposed within the interior cavity 138 of housing 130 (the upper portion of which has been removed in FIG. 9 for clarity). The latch assembly 200 includes a latch 210 having, on one end, a retaining element 220. In the embodiment of FIG. 9, the retaining element 220 comprises a blade-like structure including an end 222 configured for engagement with a mating receptacle 205 disposed on the interior of access door 10. When the end 222 of retaining element 220 is fully (or at least partially) engaged with the receptacle 205, sliding motion of the access door 110 is restrained, and the access door 110 is maintained in the closed position, as shown in FIG. 9. The receptacle 205 on access door 110 comprises a hole or slot, one or more protrusions or tabs, or any other combination of surfaces that is adapted to be engaged by the end 222 of the retaining element 220 on latch 210.

Figure 10:
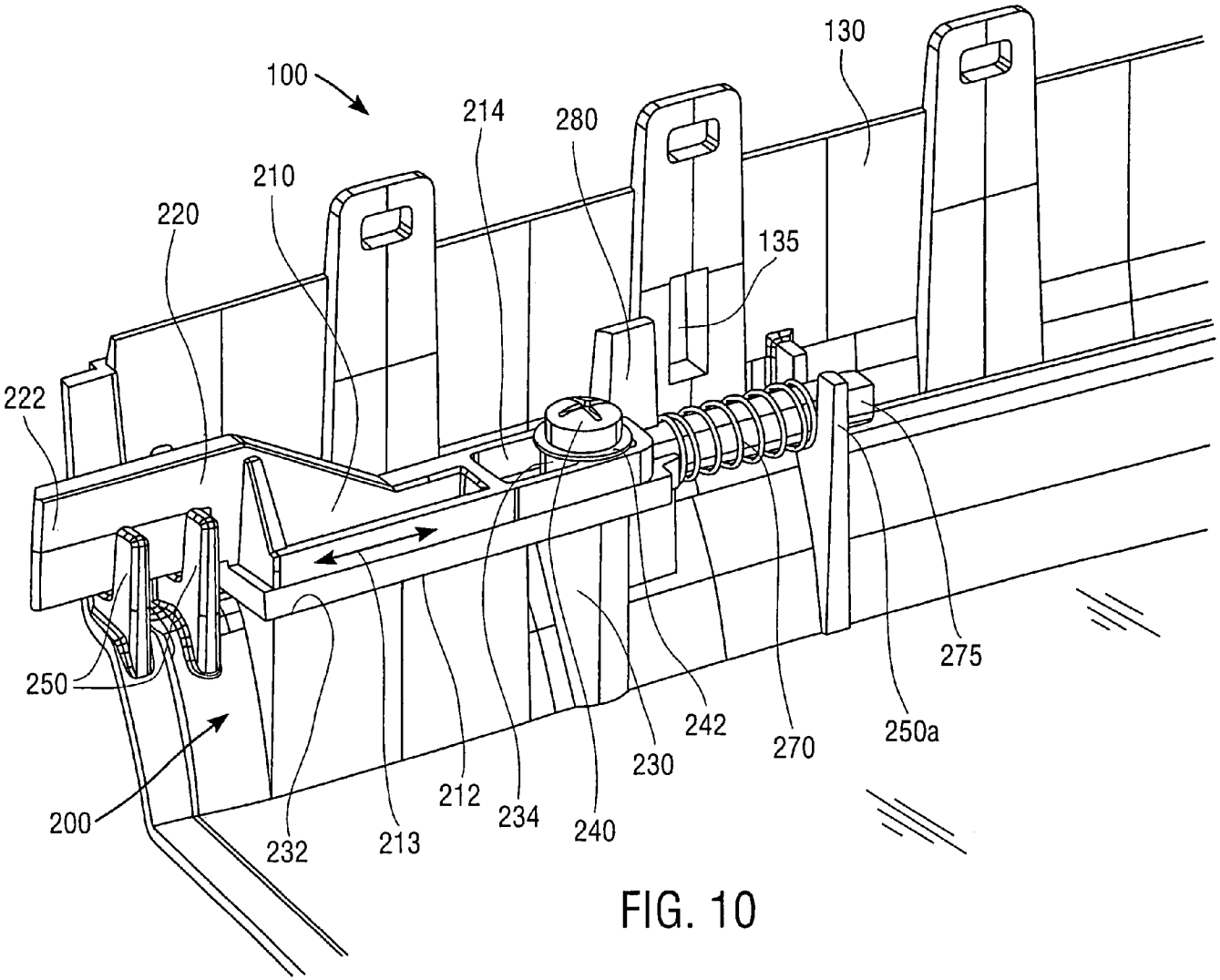
FIG. 10 is another perspective view of the interior cavity of the electronic device of FIG. 8 and further showing the latch assembly of FIG. 9.

Referring now to both FIGS. 9 and 10 (note that, in FIG. 10, the access door 110, as well as the upper portion of housing 130, are not shown for clarity), the latch 210 is supported by a base 230 having a surface (or surfaces) 232 slidably engaged with a surface (or surfaces) 212 of latch 210. The latch 210 is movable relative to the base 230 along a direction denoted by arrow 213, such that the retaining element 220 on latch 210 may be selectively engaged with, or disengaged from, the receptacle 205 on access door 110. A guide post 234 (see FIG. 10) extends upwardly from the base 230 and through a slot 214 in latch 210, and a fastening element 240 attached to guide post 234 slidably secures the latch 210 to base 230. The fastening element 240 may comprise any suitable fastener known in the art and, further, may include a spacer or washer 242.

Motion of the latch 210 is restricted along the direction 213 by the sliding engagement of surface 232 of base 230 with the surface 212 of latch 210 in conjunction with the sliding engagement between guide post 234 and the slot 214 on latch 210. The movement of latch 210 may be further restricted by one or more guide elements 250, the guide elements 250 slidably mating with the retaining element 220. The guide elements 250 shown in FIGS. 9 and 10 are only exemplary, and it should be understood that such guide elements 250 may engage any surface or portion of the latch 210 and, further, that any suitable number of guide elements 250 may be employed.

Figure 11:
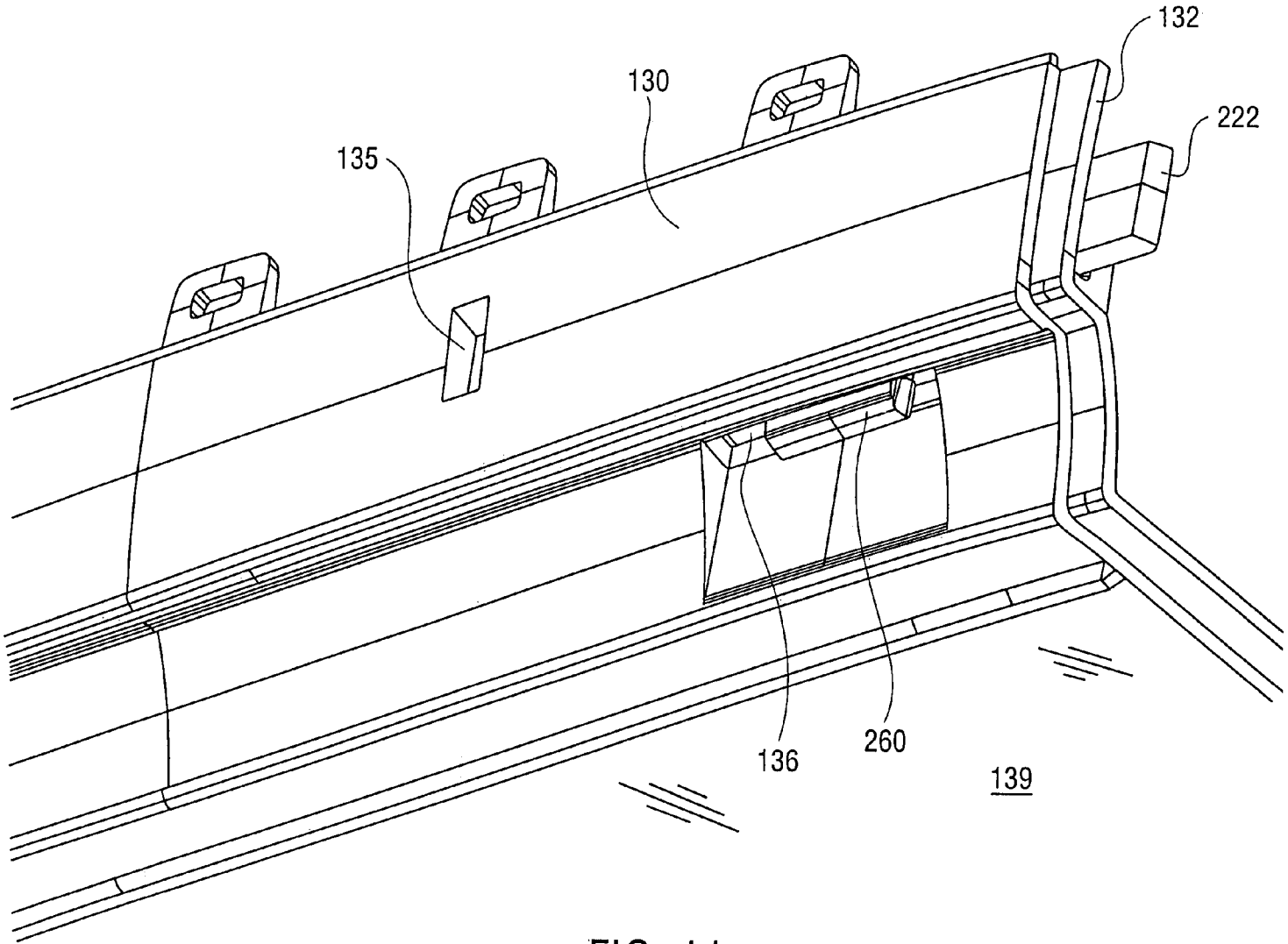
FIG. 11 is a partial perspective view of the exterior of the electronic device of FIG. 8.

To facilitate operation of the latch assembly 200, the latch 210 may include a handle 260 extending outwardly through an aperture 136 in housing 130, as illustrated in FIG. 11. FIG. 11 shows a portion of the housing 130 of electronic device 100, as viewed from an underside 139 of the housing 130. A user may operate the handle 260—by, for example, sliding the handle 260 within aperture 136 in a direction generally parallel with the direction of movement 213 of latch 210—to selectively engage (or disengage) the retaining element 220 with the receptacle 205 on access door 110. Thus, the user can release the access door 110 from latch assembly 200, enabling the operator to move the access door 110 toward an open position. In an alternative embodiment, the latch assembly 200 may be operated using an actuator, such as, by way of example, an electromagnetic solenoid.

Returning again to FIGS. 9 and 10, the latch assembly 200 may further include a biasing element 270. The biasing element 270 may comprise any suitable spring or elastomeric element known in the art. For example, as illustrated in FIGS. 9 and 10, the biasing element 270 may comprise a compression spring disposed around a shaft 275 extending from an opposing end of the latch 210. Movement of the shaft 275 is guided by another guide element 250*a*, the guide element 250*a* also serving as a stop for the biasing element (e.g., compression spring) 270. The biasing element 270 maintains the retaining element 220 in full (or at least partial) engagement with the receptacle 205 on access door 110; therefore, unless or until a user actuates the latch assembly 200, the latch 210 is biased toward the access door 110 and the latch assembly 200 will secure the access door 110 in the closed position.

The latch assembly 200 also includes a stop element 280 disposed on the latch 210 at a location and orientation that positions the stop element 280 adjacent the slot 135 in housing 130. If the lock head of a locking device is inserted into the slot 135, the lock head can engage the stop element 280 and obstruct movement of the latch 210 along its direction of movement 213, as will be explained in greater detail below. Accordingly, a locking device coupled with the housing 130 can maintain engagement between the retaining element 220 and the receptacle 205 on access door 110, thereby securing the access door 110 in a closed position and providing theft deterrence for both the lamp 140 and the electronic device 100 as a whole.

Figure 12:
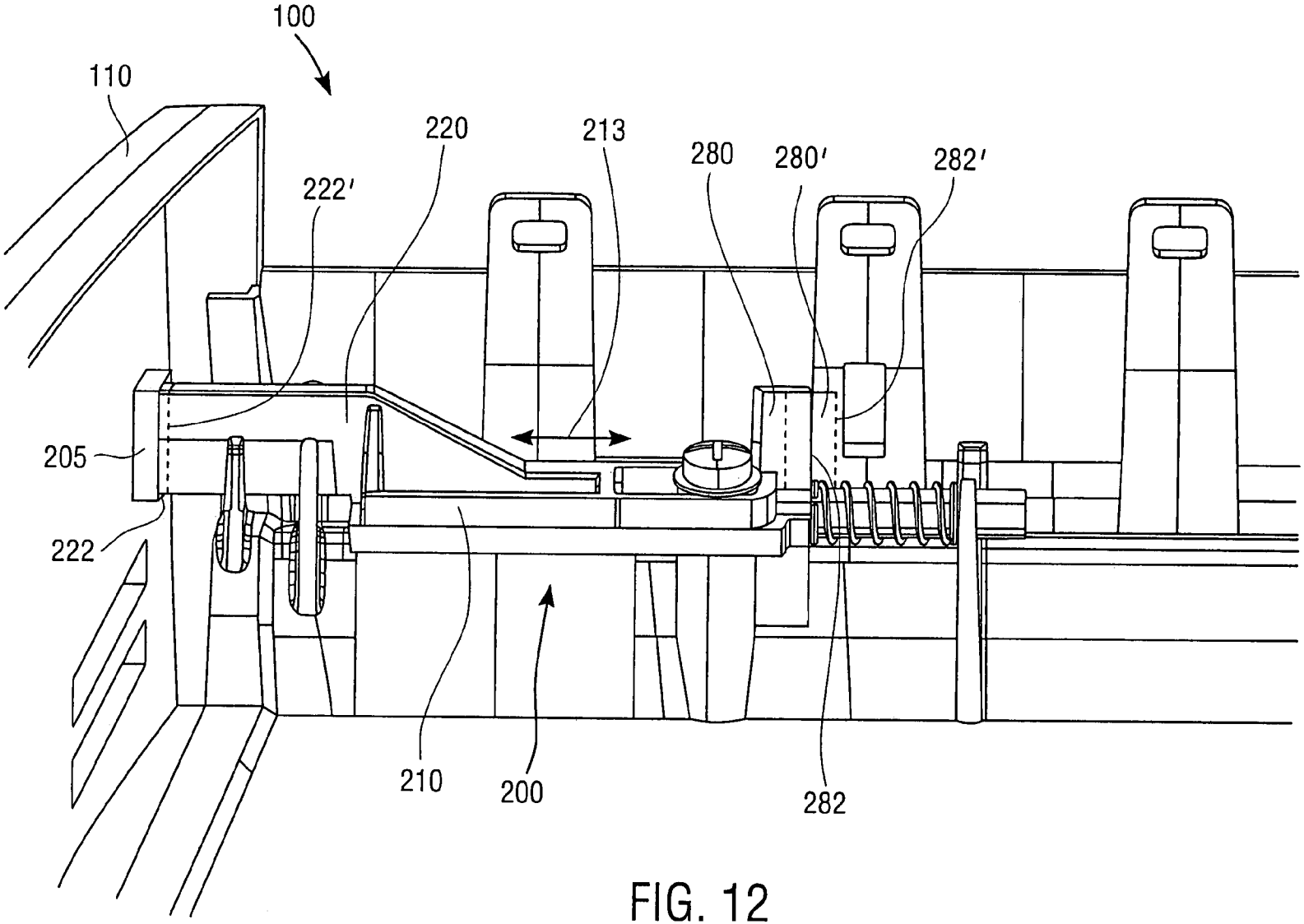
FIG. 12 is a perspective view of the latch assembly of FIG. 9 showing the latch assembly in both an extended and retracted position.

Operation of the latch assembly 200 to move the latch 210 from the engaged position to the retracted (disengaged) position is illustrated in FIG. 12. Prior to actuation of the latch assembly 200, as shown in FIG. 12, the biasing element 270 biases the latch 210 toward the access door 110 on housing 130, such that the end 222 of retaining element 220 is engaged with the receptacle 205 on access door 110, thereby securing the access door 110 in the closed position. Upon actuation of the latch assembly 200 by movement of the attached handle 260, the latch 210 is moved rearward (away from access door 110) along direction 213 until the end 222 of retaining element 220 is disengaged from the receptacle 205 on access door 110, this retracted position of the end 222 being denoted as 222' (shown in dashed line). Further, during actuation of latch assembly 200, as can be seen in FIG. 12, the stop element 280 is displaced to a position 280' (also denoted by dashed line) that lies in close proximity to the slot 135. When the latch 210 is in the retracted position and the retaining element 220 disengaged from the receptacle 205, the access door 110 may be moved towards the open position.

The latch assembly 200 may be constructed from any suitable material or combination of materials. The base 230, guide post 234, and guide elements 250, 250*a* may all be formed integral with the housing 130, in which case each will be formed of the same material as the housing 130. Alternatively, each of the base 230, guide post 234, and guide elements 250, 250*a* may comprise separately attached parts—or a single integrated part—constructed of any suitable material, including both ferrous and non-ferrous metals, plastics, and composites. The latch 210, retaining element 220, handle 260, shaft 275, and stop element 280 may also be formed of any suitable material, including both ferrous and non-ferrous metals, plastics, and composite materials. Further, the latch 210, retaining element 220, handle 260, shaft 275, and stop element 280 (or a selected portion thereof) may be formed as a single integrated part constructed of, for example, molded plastic.

Figure 13:
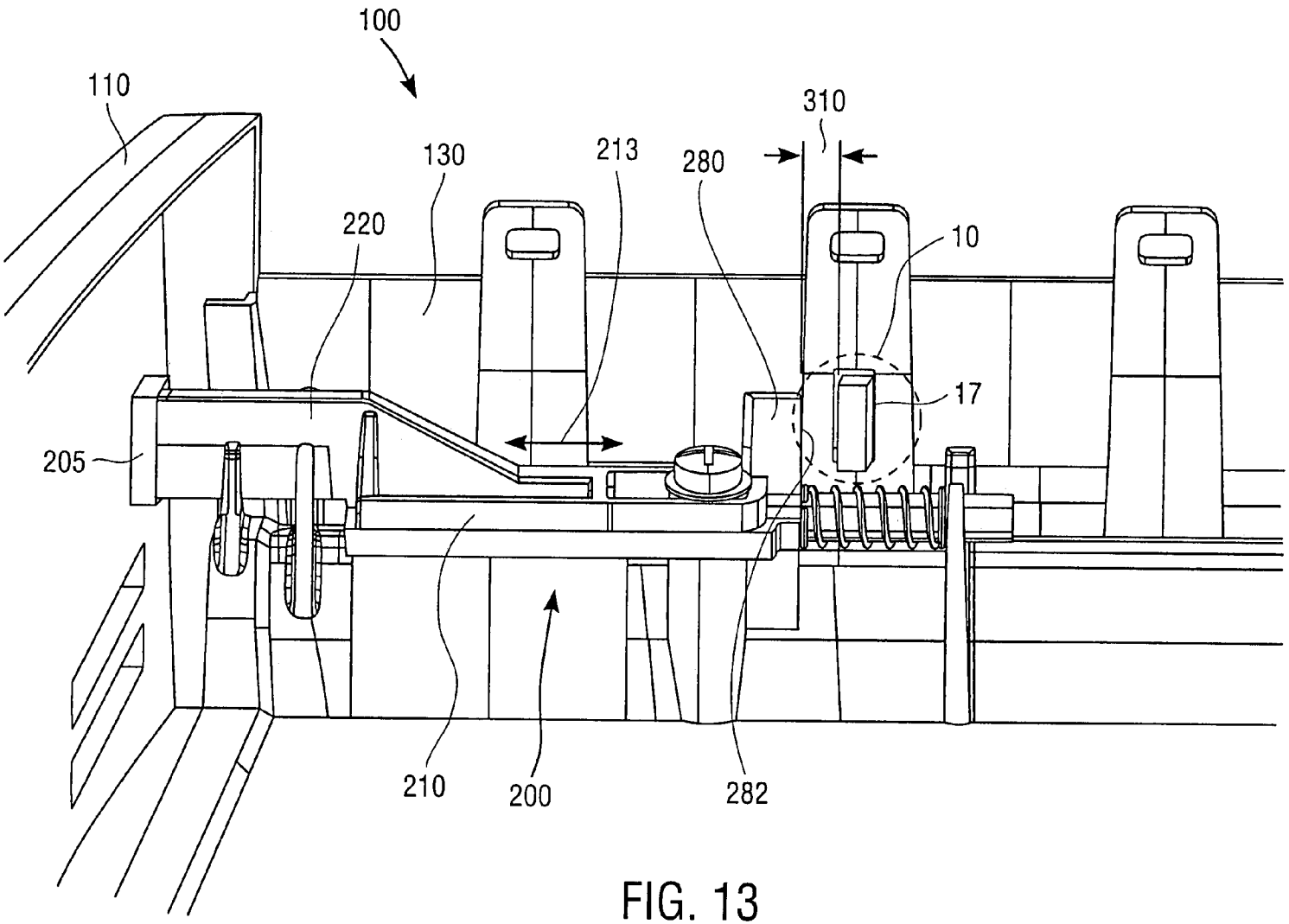
FIG. 13 is a perspective view of the latch assembly of FIG. 9 in conjunction with the cable lock of FIG. 1 exhibiting a first orientation.
Figure 14:
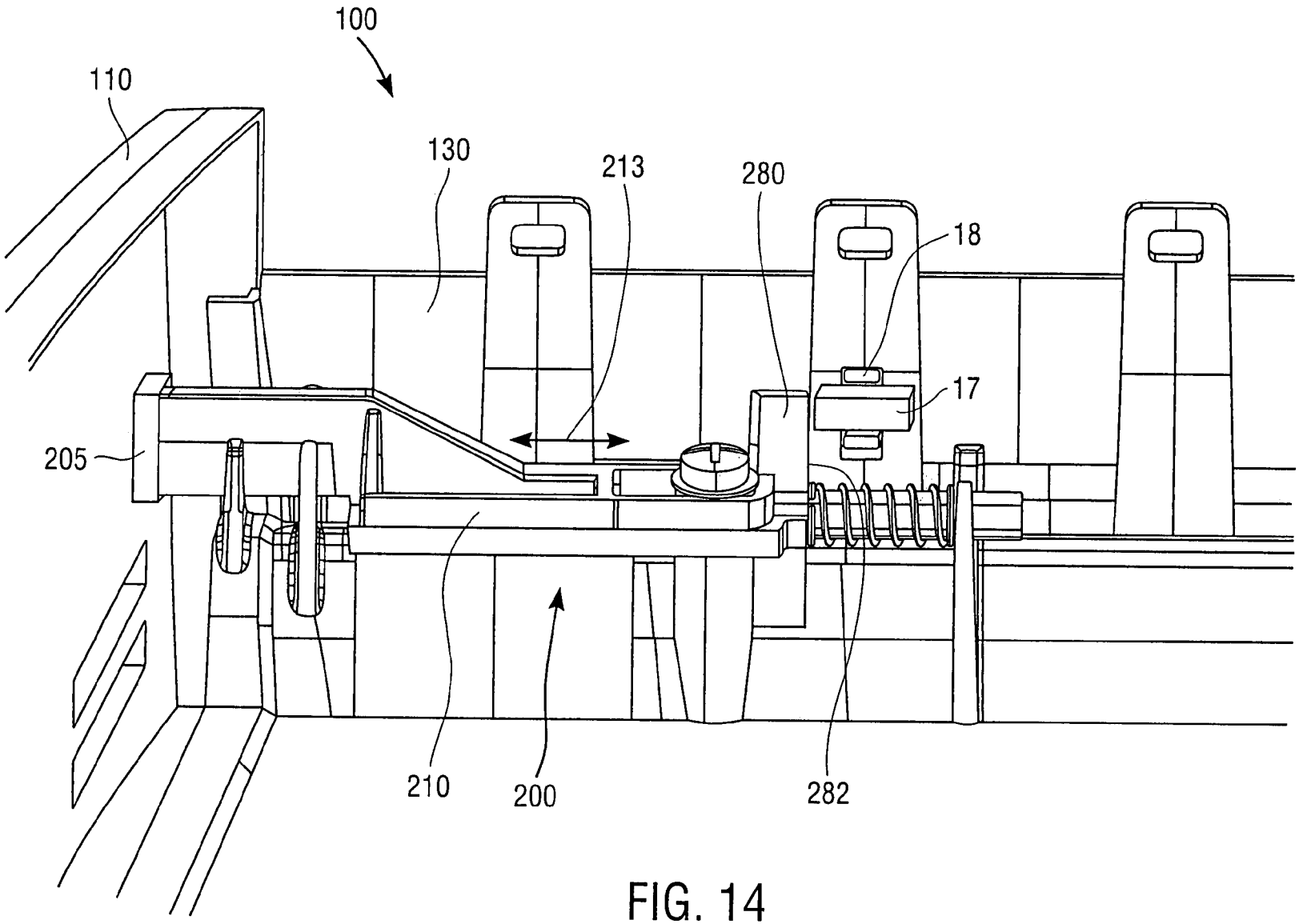
FIG. 14 is a perspective view of the latch assembly of FIG. 9 in conjunction with the cable lock of FIG. 1 exhibiting a second orientation.
Figure 15:
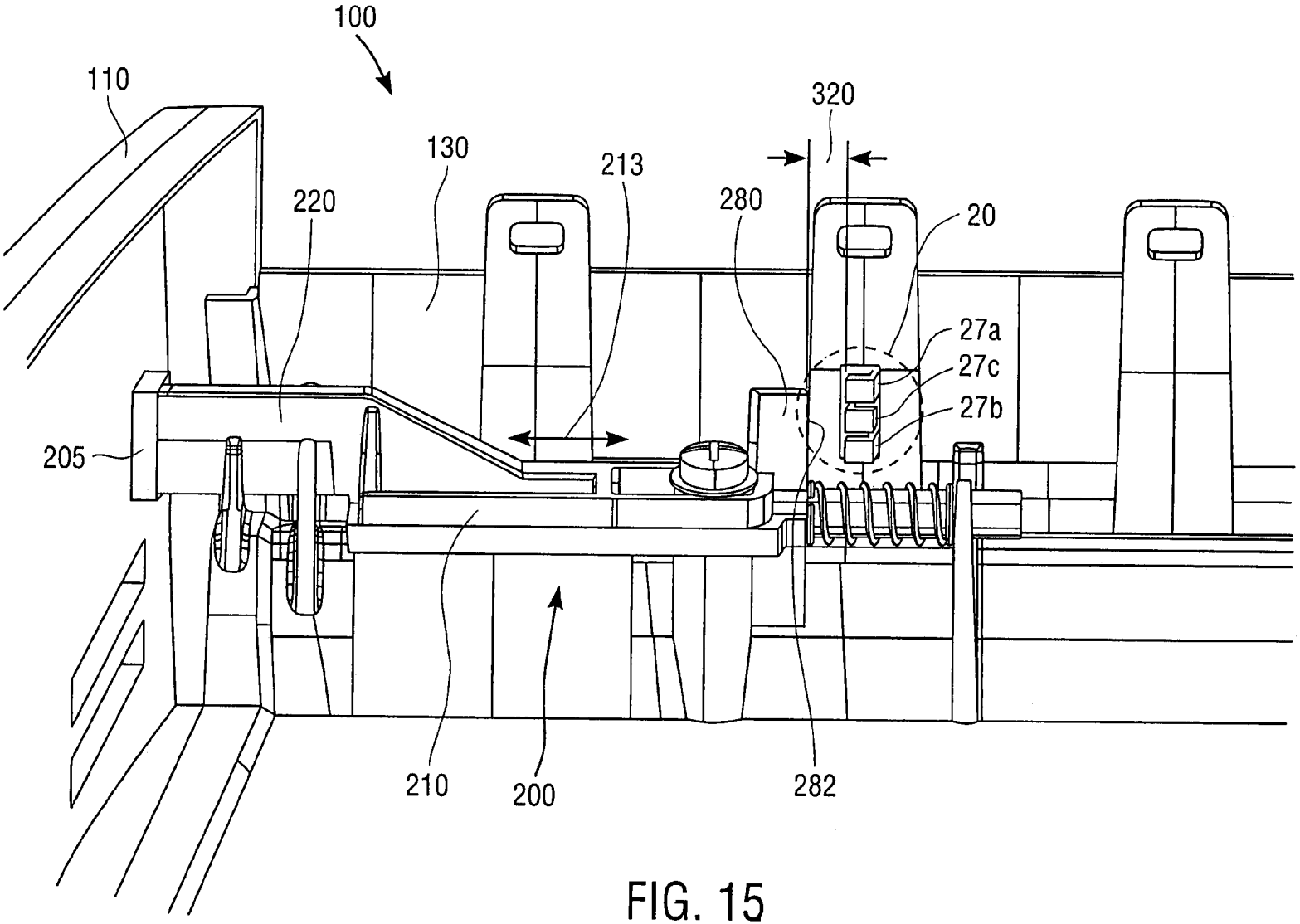
FIG. 15 is a perspective view of the latch assembly of FIG. 9 in conjunction with the scissors lock of FIG. 2 exhibiting a first orientation.
Figure 16:
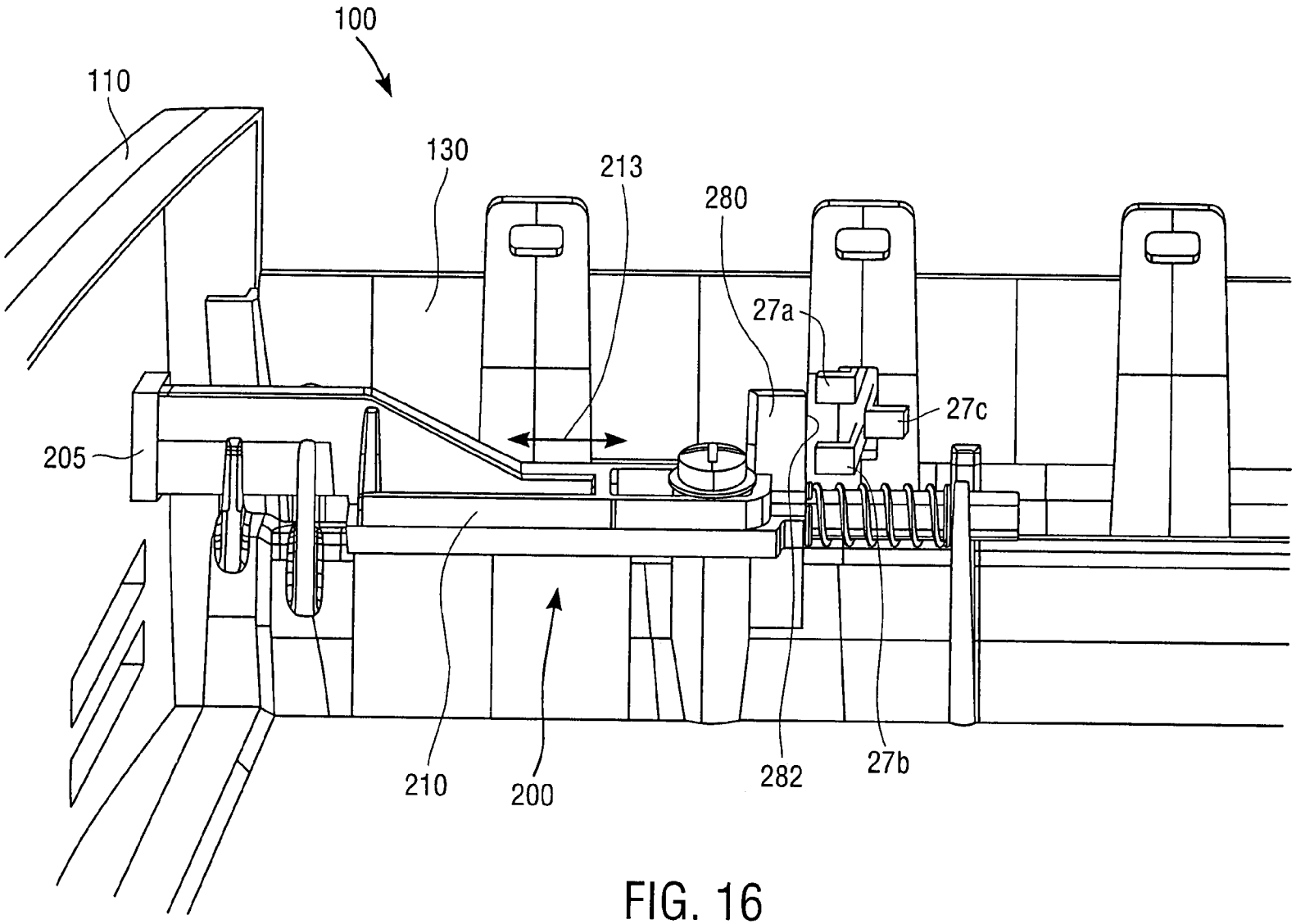
FIG. 16 is a perspective view of the latch assembly of FIG. 9 in conjunction with the scissors lock of FIG. 2 exhibiting a second orientation.

Operation of the latch assembly 200 in conjunction with a locking device is illustrated in FIGS. 13 through 16. FIGS. 13 and 14 illustrate operation of the latch assembly 200 with a Kensington® style lock 10, while FIGS. 15 and 16 illustrate operation of the latch assembly 200 with a scissors lock 20. It should be understood, however, that the embodiments presented in FIGS. 13 through 16 are only exemplary and, further, that the latch assembly 200 may function with any other suitable locking device known in the art, so long as the locking device includes a lock head configured to mate with the slot 135 in housing 130.

As shown in FIG. 13, the lock head 17 of a Kensington® style lock 10—the lock head 17 exhibiting a first orientation (see FIG. 2)—is inserted into the slot 135 of housing 130. With the lock head 17 exhibiting the first orientation, a gap 310 exists between the lock head 17 and an engagement surface 282 of stop element 280. The gap 310 is sufficient to allow actuation of latch assembly 200, such that the latch 210 may be retracted (using handle 260) in the direction 213 and the retaining element 220 disengaged from the receptacle 205 in access door 110 (see FIG. 12).

Figure 4:
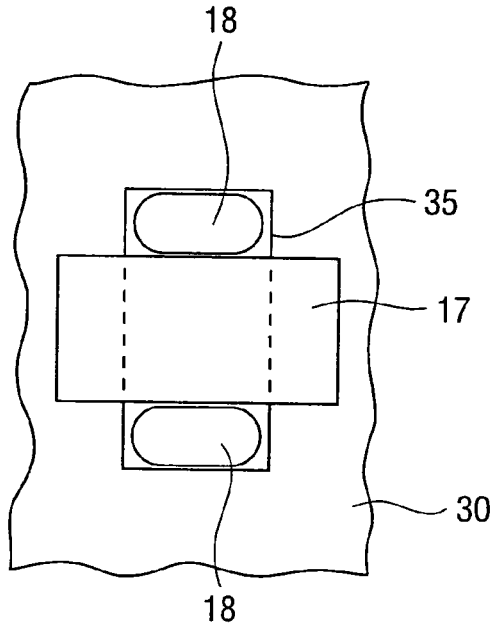
FIG. 4 (PRIOR ART)
FIG. 4 shows the cable lock of FIG. 1 in a second orientation, as engaged with the housing wall of the electronic device.

Referring to FIG. 14, upon actuation of the Kensington® style lock 10, the lock head 17 is rotated through an angle (of, for example, approximately ninety degrees) to a second orientation (see FIG. 4). In the second orientation, the lock head 17 abuts, or is proximate to, the engagement surface 282 of stop element 280. Further, the slot 135 does not allow passage of the lock head 17 in the second orientation, and the lock head 17 is retained by the housing wall 132, thereby coupling the Kensington® style lock 10 to the electronic device 100. Thus, when the lock head 17 exhibits the second orientation, the lock head 17 engages the stop element 280 and obstructs movement of the latch 210, thereby preventing the retaining element 220 from disengaging the receptacle 205 on access door 110. At the same time, the lock head 17 couples the electronic device 100 to the Kensington® style lock 10, which, in turn, may be coupled to an anchor or other stricture.

Referring now to FIG. 15, the lock head 27 of a scissors lock 20—the lock head 27 exhibiting a first orientation (see FIG. 5)—is inserted into the slot 135 of housing 130. With the lock head 27 exhibiting the first orientation, a gap 320 exists between the lock head 27 and the engagement surface 282 of stop element 280. The gap 320 is sufficient to allow actuation of latch assembly 200, such that the latch 210 may be retracted (using handle 260) along direction 213 and the retaining element 220 disengaged from the receptacle 205 in access door 110 (see FIG. 12).

Upon actuation of the scissors lock 20, as shown in FIG. 16, the lock head 27 moves to a second orientation, wherein the movable arms 27*a*, 27*b*, 27*c* of lock head 27 are outwardly extended and each of the prongs 28*a*, 28*b*, 28*c* on movable arms 27*a*, 27*b*, 27*c*, respectively, extends over a surface of the housing wall 132 (see FIG. 6). In the second orientation, the movable arms 27*a*, 27*b* (or movable arm 27*c*) abut, or are proximate to, the engagement surface 282 of stop element 280. Further, the slot 135 does not allow passage of the lock head 27 in the second orientation and the lock head 27 is retained by the housing wall 132, thereby coupling the scissors lock 20 to the electronic device 100. Thus, when the lock head 27 exhibits the second orientation, the lock head 27 engages the stop element 280 and obstructs movement of the latch 210, thereby preventing the retaining element 220 from disengaging the receptacle 205 on access door 110. At the same time, the lock head 27 couples the electronic device 100 to the scissors lock 20, which, in turn, may be coupled to an anchor or other structure.

In summary, the lock head 17, 27 of a conventional locking device 10, 20 is received in the slot 135 on housing 130 of electronic device 100, the lock head 17, 27 exhibiting a first orientation. Upon actuation of the locking device 10, 20, the lock head 17, 27 exhibits a second orientation, wherein the lock head 17, 27 is retained in the slot 135, thereby coupling the locking device 10, 20 to the housing and providing theft prevention for the electronic device 100 as a whole. In response to the lock head 17, 27 exhibiting the second orientation, the latch assembly 200 obstructs movement of the access door 110 to deter theft of one or more parts (e.g., lamp assembly 140) disposed within the housing 130. Thus, the latch assembly 200 simultaneously provides theft deterrence for the electronic device 100, as well as any specific part or component thereof, using only a single external locking device 10, 20.

The foregoing detailed description and accompanying drawings are only illustrative and not restrictive. They have been provided primarily for a clear and comprehensive understanding of the present invention and no unnecessary limitations are to be understood therefrom. Numerous additions, deletions, and modifications to the embodiments described herein, as well as alternative arrangements, may be devised by those skilled in the art without departing from the spirit of the present invention and the scope of the appended claims.

What is claimed is:

1. An apparatus lockable by a locking device having a lock head selectively changeable between an unlocked first orientation and a locked second orientation, the apparatus comprising:

a housing having an access door permitting access to a removable component located within an interior of the housing, the access door movable between a closed position and an open position;

a slot extending through the housing, the slot sized and located to receive the lock head of the locking device when the lock head exhibits the first orientation and to retain the lock head when the lock head exhibits the second orientation; and a latch assembly disposed in the housing and spring biased to maintain the access door in the closed position when the lock head exhibits the second orientation and is positioned within the slot, and to permit the access door to be opened when the lock head exhibits the first orientation and is positioned within the slot.

2. The apparatus of claim 1, wherein the removable component is disposed in the interior of the housing adjacent the access door and is accessible when the access door is in the open position.

3. The apparatus of claim 1, the removable component comprising a lamp assembly.

4. An apparatus lockable by a removable locking device having a lock head selectively changeable between an unlocked first orientation and a locked second orientation, the apparatus comprising:

a housing including an access door permitting access to a removable component located substantially within a cavity interior to the housing, the access door movable between a closed position and an open position;

a slot extending through the housing, the slot sized and located to receive the lock head of the removable locking device when the lock head exhibits the first orientation and to retain the lock head when the lock head exhibits the second orientation;

a latch spring biased to a first position to engage the access door and maintain the access door in the closed position when the lock head exhibits the second orientation, the latch movable to a second position that permits the access door to be opened when the lock head exhibits the first orientation; and a stop element disposed on the latch, the stop element to engage the lock head and to maintain the latch in the first position when the lock head exhibits the second orientation, and to allow the latch to be moved to the second position when the lock head is positioned in the slot and exhibits the first orientation.

5. The apparatus of claim 4, the latch and stop element comprising an integrated part.

6. The apparatus of claim 4, wherein the removable component is substantially disposed in the housing adjacent the access door and accessible when the access door is in the open position.

7. The apparatus of claim 4, further comprising at least one guide element disposed on the housing to restrict movement of the latch.

8. The apparatus of claim 4, further comprising a handle disposed on the latch and extending through an aperture in the housing.

9. The apparatus of claim 4, further comprising:

a retaining element disposed on the latch; and a receptacle disposed on the access door, the receptacle sized and oriented to receive an end of the retaining element.

10. A projector lockable by a locking device having a lock head selectively changeable between an unlocked first orientation and a locked second orientation, the projector comprising:

a housing including an access door situated on a first side of the housing permitting access to an interior of the housing, the access door movable between a closed position and an open position;

a lamp assembly disposed within the housing adjacent the access door;

a slot extending through a second side of the housing, the slot sized and located to receive the lock head of the locking device when the lock head exhibits the first orientation and to retain the lock head when the lock head exhibits the second orientation;

a latch spring biased to a first position to engage the access door and maintain the access door in the closed position when the lock head exhibits the second orientation, the latch movable along the second side of the housing to a second position that permits the access door to be opened when the lock head exhibits the first orientation; and a stop element disposed on the latch, the stop element to engage the lock head and to maintain the latch in the first position when the lock head exhibits the second orientation.

11. The projector of claim 10, wherein the first side is a front face of the projector, and wherein the second side is adjacent the front face.

12. The projector of claim 10, the latch and stop element comprising an integrated part.

13. The projector of claim 10, further comprising at least one guide element disposed on the housing to restrict movement of the latch.

14. The projector of claim 10, further comprising a handle disposed on the latch and extending through an aperture in the housing.

15. The projector of claim 10, further comprising:

a retaining element disposed on the latch; and a receptacle disposed on the access door, the receptacle sized and oriented to receive an end of the retaining element.

16. A projector lockable by a removable locking device having a lock head selectively changeable between an unlocked position and a locked position, the projector comprising:

a housing including an interior and an access feature providing access to the interior;

an opening extending through the housing, the opening being configured to receive the lock head of the removable locking device when the lock head is in the unlocked position, and to retain the lock head when the lock head is in the locked position;

a latch assembly movably coupled to the interior of the housing, wherein the latch assembly includes a retaining element that is spring biased to a latched position to be joined with a complementary retaining element on the access feature when the lock head is in the locked position, and to be disengaged from the complementary retaining element on the access feature when the latch assembly is in an unlatched position, and wherein the latch assembly is movable from the latched position to the unlatched position when the lock head is disposed within the opening and positioned in the unlocked position.

17. The projector of claim 16, wherein the access feature is an access door positioned on a front portion of the projector, and wherein the latch assembly is movably coupled to a side portion of the projector.

18. The projector of claim 16, further comprising a stopping member disposed on the latch assembly, wherein the stopping member is positioned on the latch assembly in such a location that, when the lock head is in the locked position, the stopping member contacts the lock head before the retaining element is fully disengaged from the complementary retaining element, and, when the lock head is in the unlocked position, the stopping member contacts the lock head after the retaining element is fully disengaged from the complementary retaining element.

19. The projector of claim 16, wherein the retaining element is a protrusion disposed on an end of the latch assembly, and wherein the complementary retaining element is a receptacle disposed on the access feature configured to receive the protrusion.

20. An apparatus lockable by a locking device having a lock head selectively changeable between an unlocked first orientation and a locked second orientation, the apparatus comprising:

a housing having an access door permitting access to a cavity within the housing;

a lens assembly substantially disposed within the housing;

a lamp assembly substantially disposed within the housing, wherein the access door permits access to the lamp assembly within the housing;

a slot extending through the housing, the slot sized and located to receive the lock head of the locking device and to retain the lock head when the lock head exhibits the locked orientation; and a latch assembly disposed in the housing and spring biased to maintain the access door in a closed position when the lock head exhibits the locked second orientation and is positioned within the slot, and to permit the access door to be opened when the lock head exhibits the first orientation and is positioned within the slot.

21. The apparatus of claim 20, further comprising a removable component disposed in the cavity adjacent the access door and accessible when the access door is in an open position.

22. The apparatus of claim 21, wherein the removable component is at least a portion of the lens assembly.

23. The apparatus of claim 21, wherein the removable component is at least a portion of the lamp assembly.

24. The apparatus of claim 22, wherein the lock head of the locking device exhibits a first orientation within the slot in which the access door is permitted to open, and exhibits a second orientation in which the access door in secured in a closed position.

* * * * *